US006759931B1

(12) United States Patent
Lias et al.

(10) Patent No.: US 6,759,931 B1
(45) Date of Patent: Jul. 6, 2004

(54) MAGNETIC MEMBER, CIRCUIT BREAKER EMPLOYING THE SAME, AND METHOD OF MANUFACTURING THE SAME

(75) Inventors: Edward E. Lias, Aliquippa, PA (US); Michael J. Whipple, Rochester, PA (US)

(73) Assignee: Eaton Corporation, Cleveland, OH (US)

( * ) Notice: Subject to any disclaimer, the term of this patent is extended or adjusted under 35 U.S.C. 154(b) by 104 days.

(21) Appl. No.: 10/359,037

(22) Filed: Feb. 5, 2003

(51) Int. Cl.[7] ..... H01N 77/00; H01N 81/00; H01N 83/00

(52) U.S. Cl. ..... 335/35; 335/167

(58) Field of Search ..... 336/233–234, 336/212; 335/35–42, 167–176

(56) References Cited

U.S. PATENT DOCUMENTS 1,971,205 A * 8/1934 Walle ..... 335/37
4,170,890 A 10/1979 Kojima
4,706,054 A * 11/1987 Hampton et al. ..... 335/203
4,733,033 A * 3/1988 Morris et al. ..... 200/401
4,969,345 A 11/1990 Zonneveld et al.
5,099,675 A 3/1992 Heath
5,381,120 A * 1/1995 Arnold et al. ..... 335/35
5,805,038 A 9/1998 Palmer et al.
5,872,495 A * 2/1999 DiMarco et al. ..... 335/35

* cited by examiner

*Primary Examiner*—Tuyen T. Nguyen
(74) *Attorney, Agent, or Firm*—Martin J. Moran

(57) ABSTRACT

A circuit breaker includes separable contacts and an operating mechanism having a cradle for opening and closing the separable contacts. A trip mechanisms cooperates with the cradle of the operating mechanism to trip open the separable contacts. The trip mechanism includes a bimetal conductor, which is electrically connected in series with the separable contacts. The trip mechanism is responsive to a predetermined condition of current flowing in the bimetal conductor. The trip mechanism also includes a magnetic yoke coupled to the bimetal conductor, an armature pivotally mounted to the magnetic yoke, and a spring biasing the armature away from the magnetic yoke. The spring is set apart from the bimetal conductor. The spring is coupled to the armature and engages the magnetic member.

23 Claims, 8 Drawing Sheets

MAGNETIC MEMBER, CIRCUIT BREAKER EMPLOYING THE SAME, AND METHOD OF MANUFACTURING THE SAME

CROSS-REFERENCE TO RELATED APPLICATIONS

This application is related to commonly assigned concurrently filed:

U.S. patent application Ser. No. 10/359,037, filed Feb. 5, 2003, entitled "Magnetic Member, Circuit Breaker Employing the Same, and Method of Manufacturing the Same";

U.S. patent application Ser. No. 10/358,991, filed Feb. 5, 2003, entitled "Non-Conductive Barrier for Separating a Circuit Breaker Trip Spring and Cradle";

U.S. patent application Ser. No. 10/359,035, filed Feb. 5, 2003, entitled "Circuit Breaker Operating Mechanism With a Metal Cradle Pivot"; and U.S. patent application Ser. No. 10/359,036, filed Feb. 5, 2003, entitled "Self-Contained Mechanism On A Frame".

BACKGROUND OF THE INVENTION

1. Field of the Invention

This invention relates generally to circuit breakers and, more particularly to circuit breakers including a magnetic trip mechanism.

2. Background Information

Circuit breakers having an operating mechanism and a trip mechanism, such as a thermal trip assembly and/or a magnetic trip assembly, are known in the art. An example of such circuit breakers is disclosed in U.S. Pat. No. 5,805,038, which is incorporated by reference herein. The trip mechanism is automatically releasable to effect tripping operations and manually resettable following tripping operations. Such circuit breakers, commonly referred to as miniature circuit breakers, have been in use for many years and their design has been refined to provide an effective, reliable circuit breaker, which can be easily and economically manufactured on a large scale. As such, the ease of manufacture of such circuit breakers is of importance.

Circuit breakers of this type include at least one set of separable contacts disposed within a non-conductive housing. Typically, there is a fixed contact attached to the housing and a movable contact coupled to an operating mechanism. The operating mechanism includes a movable operating handle that extends outside of the housing. The operating handle has essentially three stable positions: on, off, and tripped. The operating mechanism further includes an operating arm, upon which the movable contact is disposed, the trip mechanism, and a cradle. The cradle is coupled to a spring and is disposed between the trip mechanism and the operating arm.

The trip mechanism may include a thermal trip capability, which responds to persistent low level overcurrents, and/or a magnetic trip capability, which responds instantaneously to higher overload currents. One such trip mechanism includes a cantilevered bimetal member, a magnetic yoke and a magnetic armature. The magnetic yoke is a generally U-shaped member secured to the bimetal member at a bight portion of the magnetic yoke with legs thereof facing the armature. The magnetic armature is secured to a supporting spring that is, in turn, secured at its lower end near a free end of the cantilevered bimetal member. Thus, the armature is supported on the bimetal member by the spring. The armature has a window opening through which one of end of the cradle extends. A latch ledge on the cradle engages the edge of the window to latch the latchable operating mechanism in the latched position. The trip mechanism includes three welds: (1) between the bight portion of the magnetic yoke and the bimetal; (2) between the lower end of the bimetal and the lower end of the spring; and (3) between the upper end of the spring and the lower end of the magnetic armature. This assembly procedure is time consuming. Furthermore, the welds are subject to failure.

There is, therefore, a need for a circuit breaker trip assembly, which reduces manufacturing time and/or cost.

There is a further need for a circuit breaker trip assembly, which minimizes a count of welds and/or improves reliability.

There is room for improvement in circuit breakers.

SUMMARY OF THE INVENTION

There needs and others are met by the present invention, which provides a single-piece magnetic bracket/armature assembly, and which incorporates the functions of a magnet, an armature having a latching surface, and an armature return spring. The armature and the armature return spring are retained within the confines of the magnetic bracket, in order that the armature performs a trip function resulting from rotational movement. The magnetic bracket may be a formed steel part, which functions as a magnet, while suitably pivotally retaining the armature during operation. The spring may be coupled to the armature and biased to a leg of the magnetic bracket.

In accordance with one aspect of the invention, a circuit breaker comprises separable contacts; an operating mechanism for opening and closing the separable contacts; a conductor electrically connected in series with the separable contacts; a trip mechanism cooperative with the operating mechanism to trip open the separable contacts, the trip mechanism responsive to a predetermined condition of current flowing in the conductor, the trip mechanism comprising: a magnetic member coupled to the conductor, an armature pivotally mounted to the magnetic member, and a spring set apart from the conductor and biasing the armature away from the magnetic member.

The armature may include an opening, and the operating mechanism may include a cradle having a latch surface, which is latched by the armature at about the opening thereof. The spring may include a latch skin, which engages the armature at the opening thereof. The latch surface of the cradle may be latched by the armature at the latch skin of the spring.

The armature may pivot toward the magnetic member responsive to the predetermined condition of current flowing in the conductor, and the armature may responsively unlatch the latch surface of the cradle.

The magnetic member may include a leg coupled to the conductor. The conductor may be a bimetal, which is welded to the leg of the magnetic member.

The armature may include an opening. The magnetic member may include an arm. The spring may include a first portion, which engages the armature at the opening thereof a second portion and a bend portion between the first and second portions, the second portion of the spring flexing and engaging the arm of the magnetic member, thereby biasing the armature away from the magnetic member.

The magnetic member may include a pair of ears having a pair of openings. The armature may include a pair of legs which pivotally engage the magnetic member at the openings of the ears. The ears of the magnetic member may be folded over, in order to capture the armature. The magnetic member may include a generally U-shaped magnetic yoke having a pair of legs facing the armature, with each of the ears being attached to a corresponding one of the legs.

As another aspect of the invention, a circuit breaker comprises: separable contacts; an operating mechanism for opening and closing the separable contacts; a conductor electrically connected in series with the separable contacts; a trip mechanism cooperative with the operating mechanism to trip open the separable contacts, the trip mechanism responsive to a predetermined condition of current flowing in the conductor, the trip mechanism comprising: a magnetic member coupled to the conductor, an armature pivotally mounted to the magnetic member, and a spring set apart from the conductor and biasing the armature away from the magnetic member, the spring coupled to the armature and engaging the magnetic member.

As another aspect of the invention, a circuit breaker comprises: separable contacts; an operating mechanism for opening and closing the separable contacts, the operating mechanism comprising a cradle; and a strip mechanism cooperative with the cradle of the operating mechanism to trip open the separable contacts, the trip mechanism comprising: a bimetal conductor electrically connected in series with the separable contacts, the trip mechanism responsive to a first predetermined condition of current flowing in the bimetal conductor, a magnetic member coupled to the bimetal conductor, an armature pivotally mounted to the magnetic member, the cradle of the operating mechanism latched on and tripped by the armature, the armature and the magnetic member responsive to a second predetermined condition of current flowing in the bimetal conductor, and a spring biasing the armature away from the magnetic member, the spring set apart from the bimetal conductor, coupled to the armature and engaging the magnetic member.

The armature may include an opening. The cradle of the operating mechanism may have a latch surface, which is latched by the armature at about the opening thereof. The armature may pivot toward the magnetic member responsive to the second predetermined condition of current flowing in the bimetal conductor. The armature may responsively unlatch the latch surface of the cradle. The spring may include a latch skin, which engages the armature at the opening thereof. The latch surface of the cradle may be latched by the armature at the latch skin of the spring.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the statement that two or more parts are "coupled" together shall mean that the parts are joined together either directly or joined through one or more intermediate parts. Further, as employed herein, the statement that two or more parts are "attached" shall mean that the parts are joined together directly.

Figure 1:
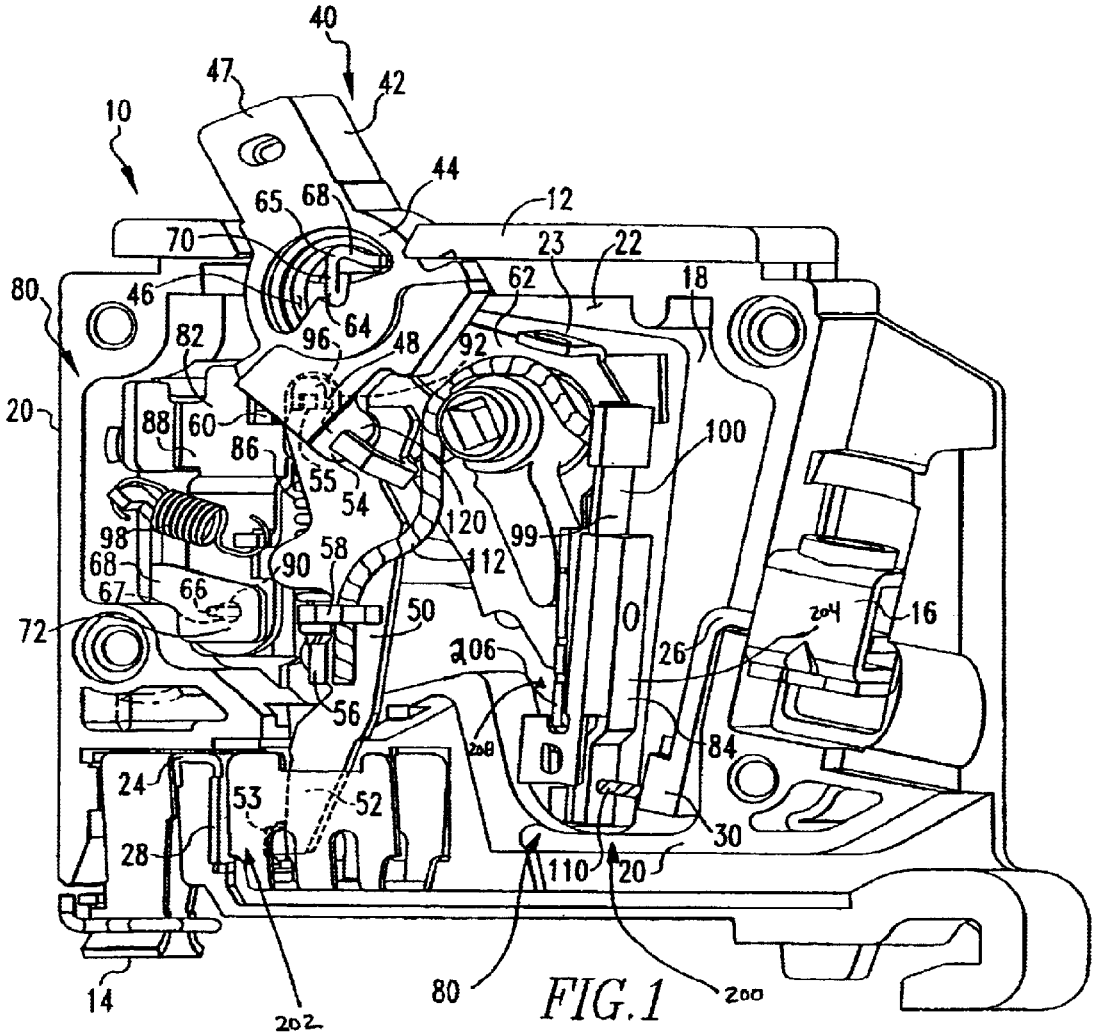
FIG. 1 is an isometric view of a circuit breaker, with an insulating cover not shown, in accordance with the present invention.

As shown in FIG. 1, a circuit breaker 10 includes a non-conductive housing 12, a first terminal conductor 14, a second terminal conductor 16 and a unitary operating mechanism assembly 40. The housing 12 includes a generally planar base wall 18 and generally perpendicular side walls 20 forming an operating mechanism cavity 22. The housing 12 further includes an insulating cover (not shown) that encloses the operating mechanism cavity 22. On the base wall 18 within the operating mechanism cavity 22 may be a recess 23 shaped to accommodate a frame assembly 60, described below. The first terminal conductor 14 and the second terminal conductor 16 are mounted in the housing 12 at locations external to the operating mechanism cavity 22. These terminal conductors 14,16 include conductive tabs, 24,26 respectively, that extend through the side walls 20 in to the operating mechanism cavity 22. The first terminal conductive tab 24 terminates in a fixed contact 28. The second terminal conductive tab 26 terminates in a contact pad 30.

Figure 2:
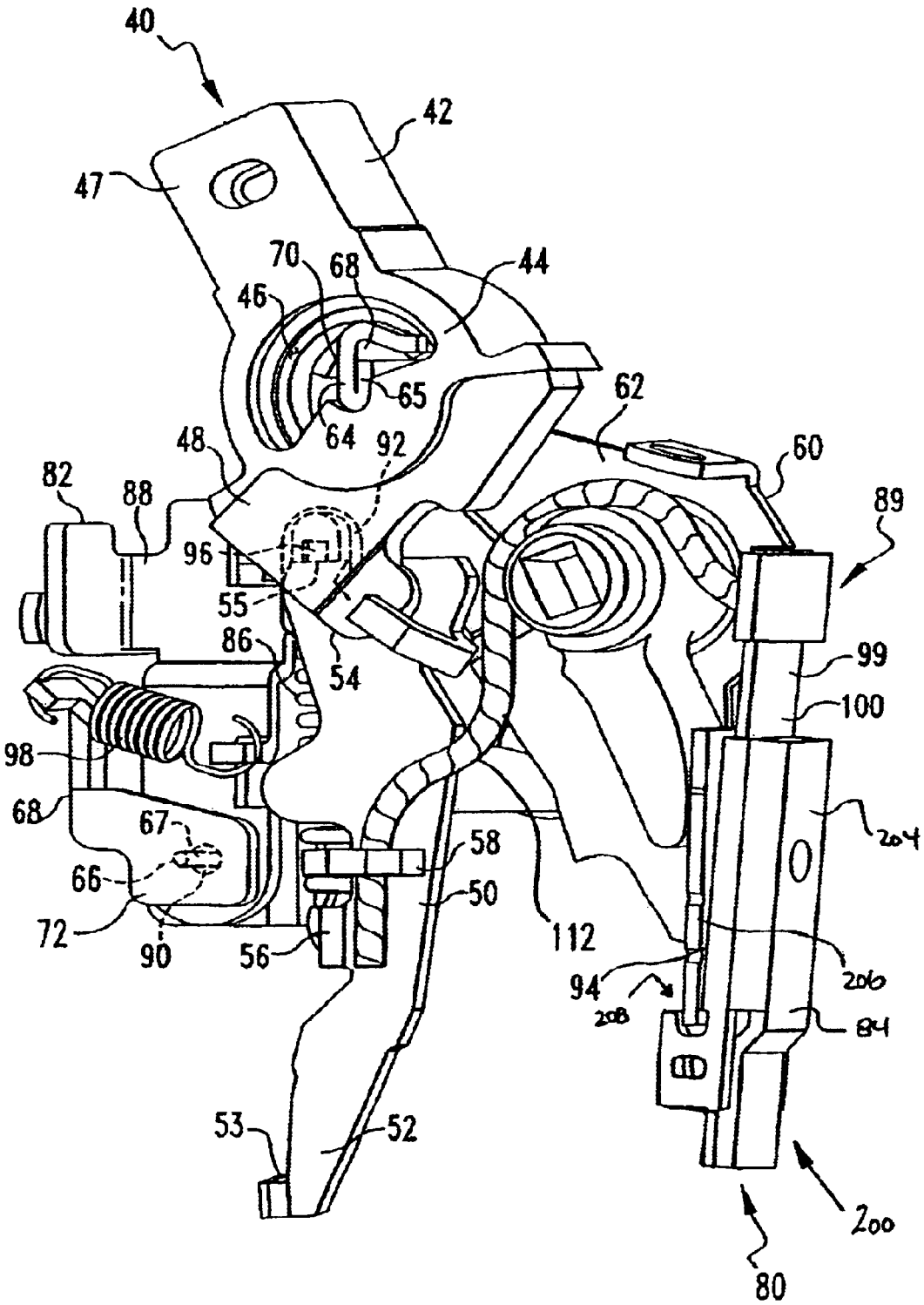
FIG. 2 is an isometric view of the operating mechanism of FIG. 1.
Figure 3:
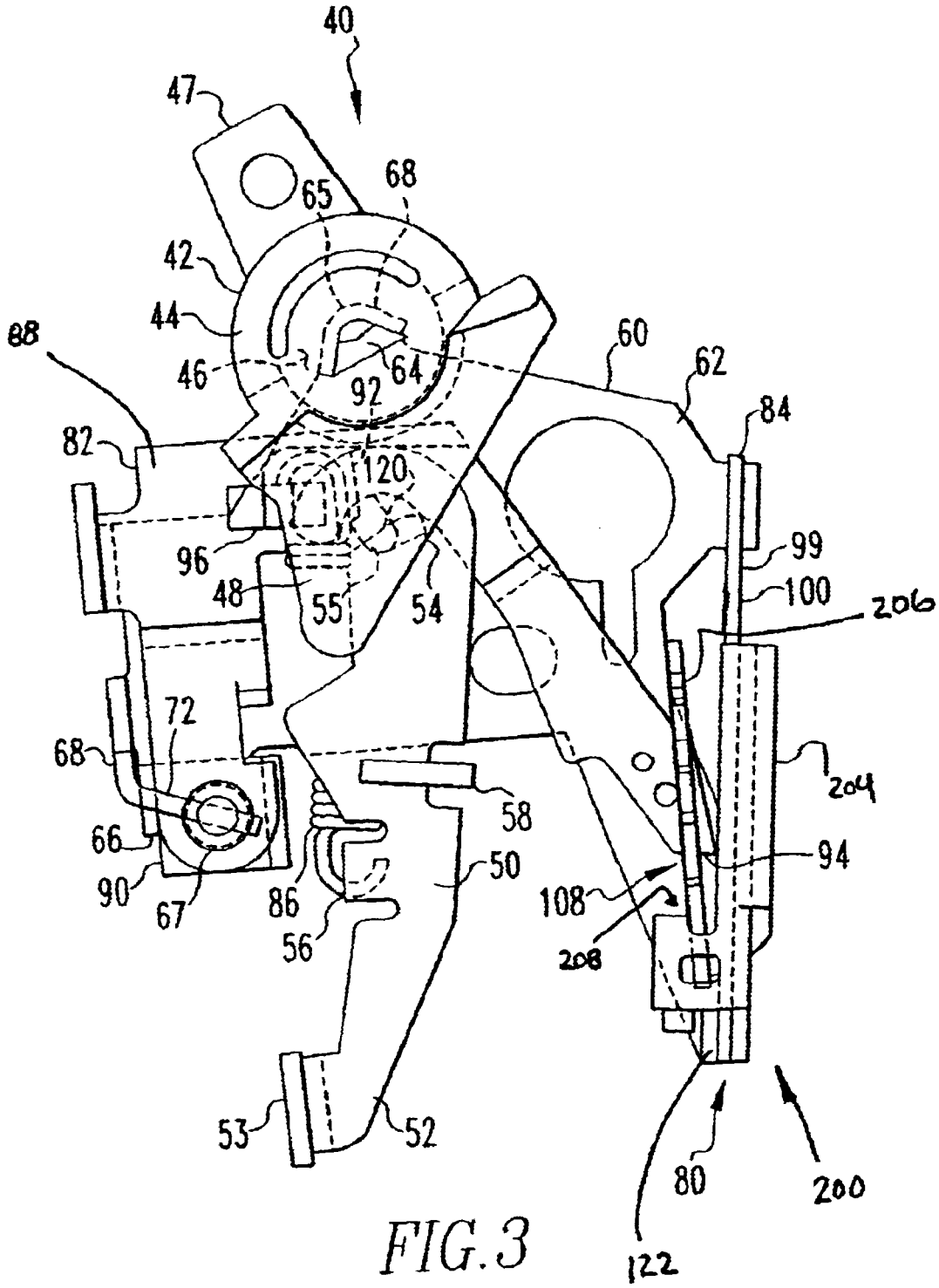
FIG. 3 is a vertical elevation view of the operating mechanism of FIG. 1.

The operating mechanism assembly 40, shown in FIGS. 1–3, includes a handle member 42, an operating arm 50, the frame assembly 60, and a trip device 80. The handle member 42 includes a generally circular portion 44 having a central opening 46, an elongated, radial extension 47 that extends out of the housing 12 and an operating arm tab 48. The handle member 42 is made from a non-conductive material. The operating arm 50 includes a contact end 52 that forms the movable contact 53, a handle member engaging end 54 having a notch 55, a spring tab 56 and a conductor bracket 58. The operating arm 50 is preferably made from a conductive metal, such as copper or brass.

The frame assembly 60 includes a generally planar member 62, which has a first pivot point 64 and a second pivot point 66. At each of the pivot points 64, 66 that is an elongated rod, which is a first elongated member 65 at the first pivot point 64 and a second elongated member 67 at the second pivot point 66. The elongated members 65,67 act as axles, as described below. At each of the pivot points 64,66 is an associated capture device 68. The capture devices 68 are structured to capture a component rotatably disposed on the elongated members 65, 67. The capture device 68 at the first pivot point 64 is preferably a bendable portion 70 at the distal end of the first elongated member 65, which portion is structured to be bent at about a right angle relative to the axis of the first elongated member 65. The capture device 68 at the second pivot point 66 is preferably an L-shaped tab 72 extending from the planar member 62. The L-shaped tab 72 is also bendable and may be initially manufactured as a plate extending perpendicular to the planar member 62. During manufacture, after a component has been disposed on the second elongated member 67, the plate is bent to have an L-shaped with the distal end of the plate over the elongated member 67. The frame assembly 60 is preferably made from a formable, relatively strong and relatively low conductance material, such as steel.

Figure 4:
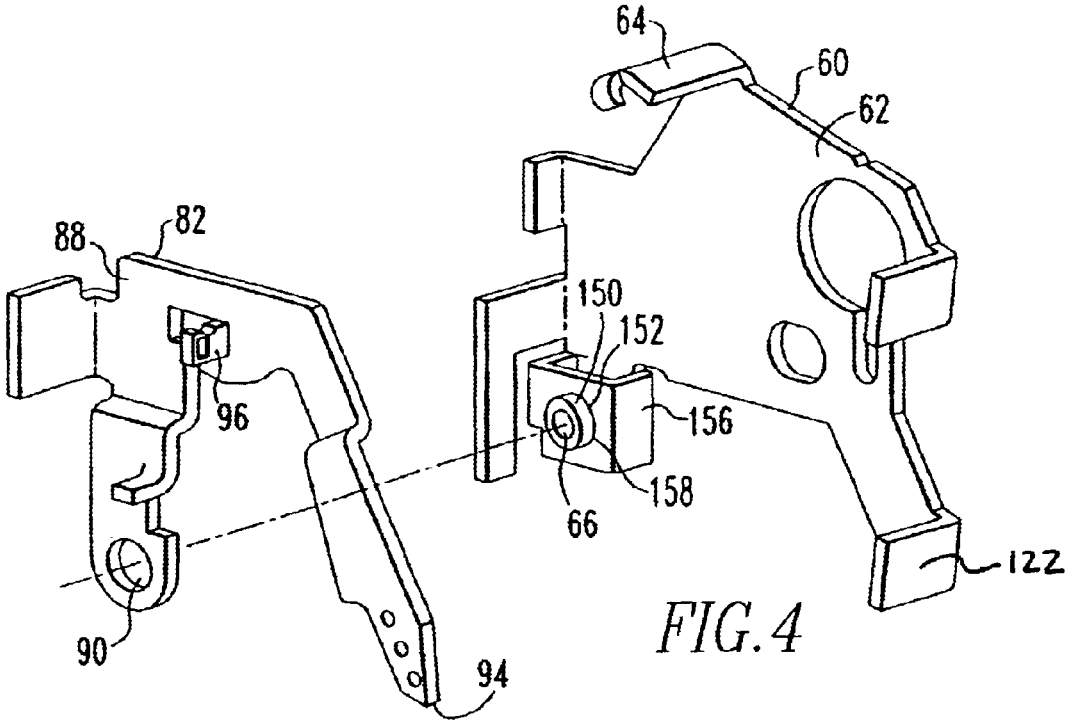
FIG. 4 is an exploded isometric view of the frame assembly and cradle of FIG. 1.

The trip device 80 includes a cradle 82, a trip assembly 84 and a trip spring 86. The cradle 82 includes a generally planar member 88 having a pivot opening 90, a handle contact point 92 and a latch ledge 94 (FIG. 3). The cradle planar member 88 is structured to be rotatably coupled to the frame assembly 60 at the second pivot point 66 by the pivot opening 90. The latch ledge 94 is latched by the trip assembly 84, as described below. The trip spring 86 is an over center spring connected, under tension, at one end to the operating arm spring tab 56 near the lower end of the operating arm contact end 52, and at the other end thereof to a trip spring projection 96 (as best shown in FIG. 4) extending from the cradle planar member 88. There may be an additional cradle planar member spring 98 extending between the cradle planar member 88 and the frame assembly 60. The cradle planar member spring 98 is preferably a tension spring disposed adjacent to the second pivot point 66 and structured to bias the cradle planar member 88 to the second, open position, described below.

Figure 5:
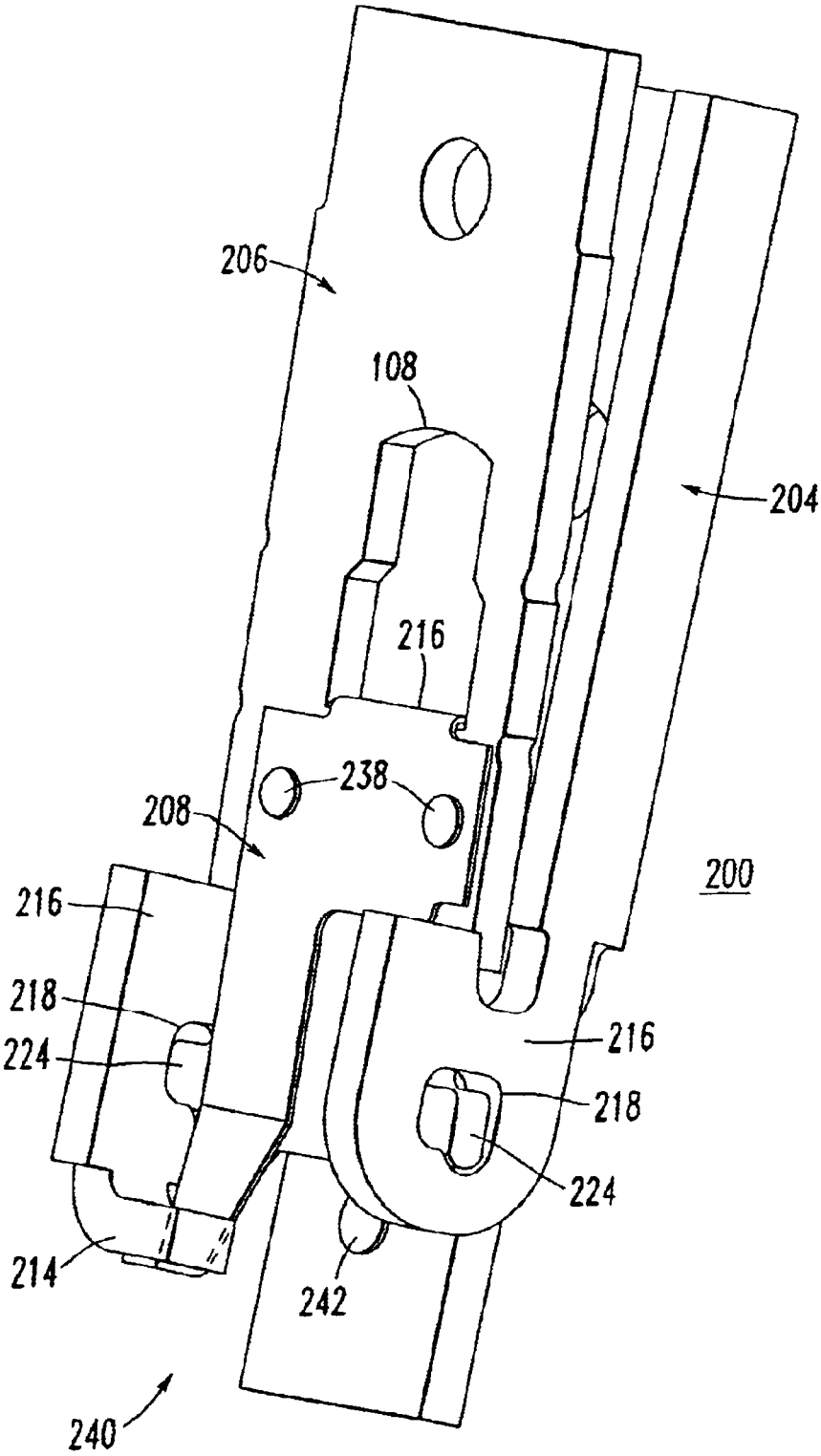
FIG. 5 is an isometric view of the magnetic bracket/armature assembly of FIG. 1.
Figure 6:
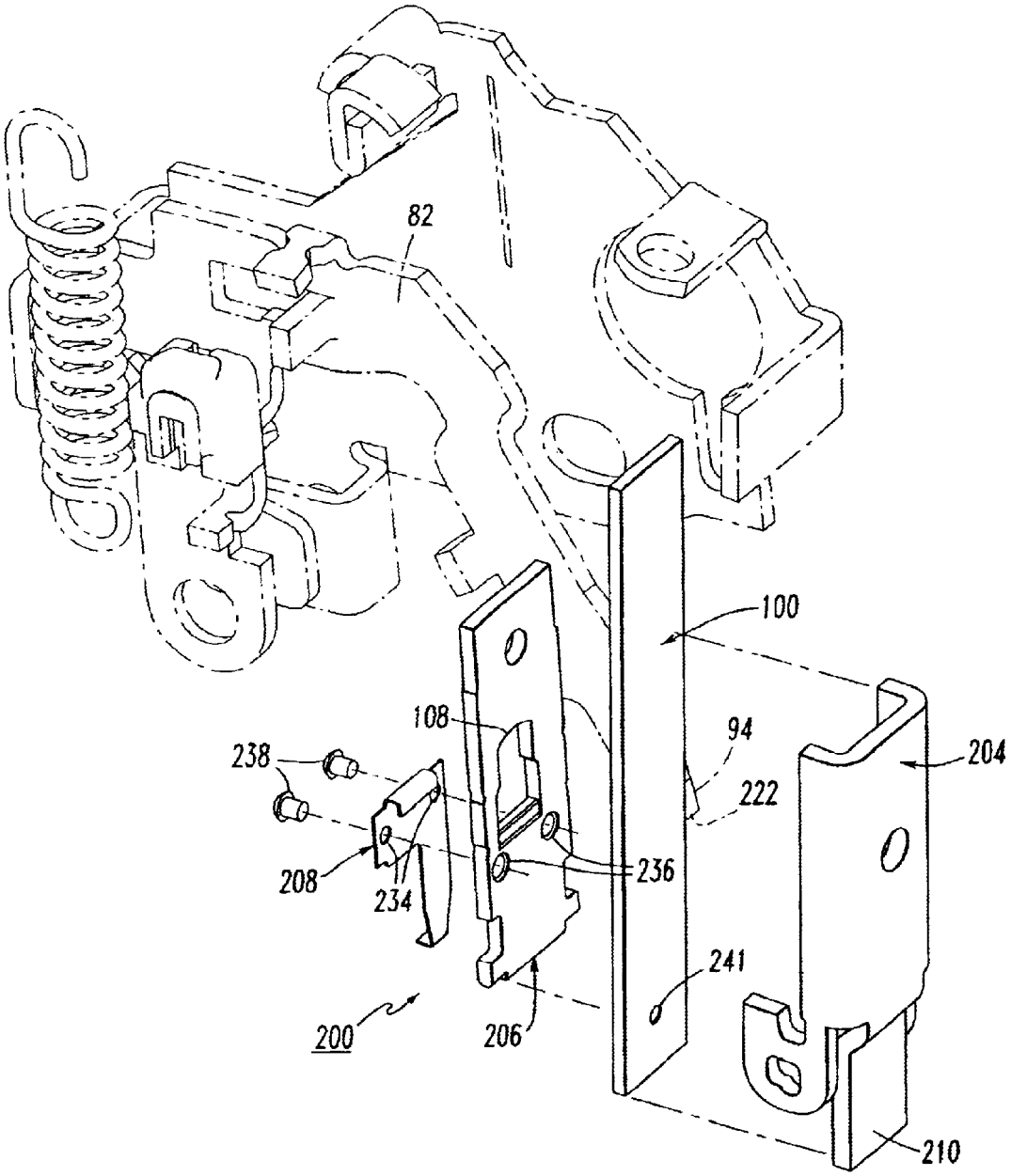
FIG. 6 is an exploded isometric view of the magnetic bracket/armature assembly and the bimetal of FIG. 1.

The trip assembly 84 includes a thermal trip device 99, which responds to persistent low level overcurrents, and a magnetic trip device, such as the magnetic bracket/armature assembly 200 of FIGS. 5 and 6, which responds instantaneously to relative higher overload currents. The thermal trip device 99 includes a bimetal member 100.

A first flexible conductor 110 is secured at one end to the fixed end of the bimetal member 100 and at the other end to the second terminal contact pad 30. A second flexible conductor 112 is secured at one end to the distal end of the bimetal member 100 and at the other end thereof to the operating arm conductor bracket 58. Thus, the operating arm 50 is electrically coupled with the bimetal member 100.

The operating mechanism assembly 40 is assembled as follows. The cradle planar member 88 is rotatably coupled to the frame assembly 60 at the second pivot point 66 by passing the second elongated member 67 through the pivot opening 90. The capture device 68 is used to secure the cradle planar member 88 to the frame assembly 60. That is, the L-shaped tab 72 is bent in order that the distal end of the L-shaped tab 72 is over the distal end of the second elongated member 67. The latch edge 94 on the cradle planar member 88 is disposed adjacent to the trip assembly 84. The handle member 42 is then rotatably coupled to the frame assembly 60 at the first pivot point 64 by passing the first elongated member 65 through the handle member central opening 46. The capture device 68 is used to secure the handle member 42 to the frame assembly 60. That is, the bendable portion 70 is bent in order that the handle member 42 cannot be removed from the first elongated member 65. The handle member 42 contacts the cradle planar member 88 at the handle contact point 92. The operating arm 50 is coupled to the handle member 42 by disposing the handle member operating arm tab 48 in the operating arm notch 55 and coupling the trip spring 86, under tension, at one end to the operating arm spring tab 56, and at the other end thereof to the trip spring projection 96 extending from the cradle planar member 88. The tension provided by the trip spring 86 biases the operating arm 50 against the handle member 42 with enough force to maintain the operating arm 50 in position. The interaction between the operating arm notch 55 and the handle member operating arm tab 48 defines an operating arm pivot point 120. The operating arm 50 is also coupled to the bimetal member 100 by attaching the second flexible conductor 112 at one the end to the bimetal member 100 and at the other end thereof to the operating arm conductor bracket 58.

In this configuration, the operating mechanism assembly 40 is structured to move the operating arm 50 between a first, closed position and a second, open position. The cradle planar member 88 is structured to be moved from a first, latched position, where the latch ledge 94 on the cradle planar member 88 engages the edge of the trip armature opening 108 (FIG. 6), to a second, unlatched position, where the latch ledge 94 on the cradle planar member 88 does not engage the edge of the trip armature opening 108.

The handle member 42 is structured to move between a first, closed position (FIG. 1), an intermediate tripped position, a second, open position, and a third, reset position. When the cradle planar member 88 is in the first, latched position (FIG. 1), moving the handle member 42 between the first, closed position and the second, open position causes a corresponding motion in the operating arm 50. That is, when the cradle planar member 88 is in the first, latched position, moving the handle member 42 between the first, closed position and the second, open position causes the operating arm 50 to move between the first, closed position and the second, open position. As described below, this action acts to manually open the circuit breaker 10. Moving the handle member 42 to the reset position while the cradle planar member 88 is in the first, latched position has, essentially, no effect. When the cradle planar member 88 is in the second, unlatched position, moving the handle member 42 to the reset position causes the cradle planar member 88 to move into the first, latched position. When the cradle planar member 88 is in the second, unlatched position, moving the handle member 42 from the intermediate position or the second, open position to the first closed position has, essentially, no effect.

When the cradle planar member 88 is in the second, unlatched position, the trip spring projection 96 coupled to the trip spring 86 of FIGS. 1–3 is to the right of an imaginary line (not shown) between the operating arm notch 55 and the operating arm contact end 52. When the cradle planar member 88 is in the first, latched position, the trip spring projection 96 coupled to the trip spring 86 is to the left, as shown in FIGS. 1–3, of an imaginary line (not shown) between the operating arm notch 55 and the operating arm contact end 52. Thus, when the cradle planar member 88 is in the second, unlatched position, the trip spring 86 moves the operating arm 50 to the second, open position. When the cradle planar member 88 is in the first, latched position, the operating arm 50 may be moved by handle member 42 into either the first, closed position or the second, open position. Because the components of the operating mechanism assembly 40 are coupled and secured to each other, the operating mechanism assembly 40 may perform the motions described above while disposed outside of a circuit breaker housing, such as 12. That is, no component of the operating mechanism assembly 40 pivots on the circuit breaker housing 12 and no component, other than the frame assembly 60, is attached to the housing 12.

To assemble the circuit breaker 10, the operating mechanism assembly 40 is disposed in the operating mechanism cavity 22. The operating mechanism assembly 40 may be coupled to the circuit breaker housing 12 by any suitable coupler, such as, for example, a fastener or glue. The first flexible conductor 110 is secured at one end to the fixed end of the bimetal member 100 and at the other end to the second terminal contact pad 30. The second flexible conductor 112 is secured at one end to the distal end of the bimetal member 100 and at the other end thereof to the operating arm conductor bracket 58. The operating arm contact end 52 is disposed adjacent to the fixed contact 28. When the operating arm 50 is in the first, closed position, the movable contact 53 and the fixed contact 28 are in electrical communication. When the operating arm 50 is in the second, open position, the movable contact 53 and the fixed contact 28 are separated. Thus, when the operating arm 50 is in the first, closed position, there is a first electrical circuit through the circuit breaker 10 extending from the first terminal conductor 14, through the fixed contact 28, the movable contact 53, the operating arm 50, the second flexible conductor 112, the bimetal member 100, the first flexible conductor 110, the contact pad 30, and the second terminal conductor 16.

The bimetal member 100 is coupled (e.g., welded) at one end to a leg 122 of the frame assembly 60.

Referring to FIGS. 1, 5 and 6, the magnetic bracket/armature assembly 200 is shown. A suitable conductor, such as the bimetal member 100, is electrically connected in series with the separable contacts 202 formed by the fixed contact 28 and the movable contact 53. The trip assembly 84 responds to a predetermined condition of current (a persistent low level overcurrent) flowing in the bimetal member 100, and cooperatives with the cradle 82 of the operating mechanism assembly 40 to trip open the separate contacts 202. The trip assembly 84 includes a magnetic yoke/bracket member 204 suitably coupled (e.g., attached, welded) to the bimetal member 100 and an armature 206 pivotally mounted to the magnetic member 204. The operating mechanism cradle 82 is latched on and tripped by the armature 206. The trip assembly 84 further includes a spring 208 biasing the armature 206 away from the magnetic member 204. The spring 208 is set apart from the bimetal member 100, is coupled to the armature 206, and engages the magnetic member 204.

The armature 206 has the opening 108 through which the latch edge 94 on the cradle planar member 88 extends, thereby engaging the edge of the opening 108. This acts to latch the operating mechanism assembly 40 in the first, closed position, as shown in FIG. 1 and as described below.

Figure 7:
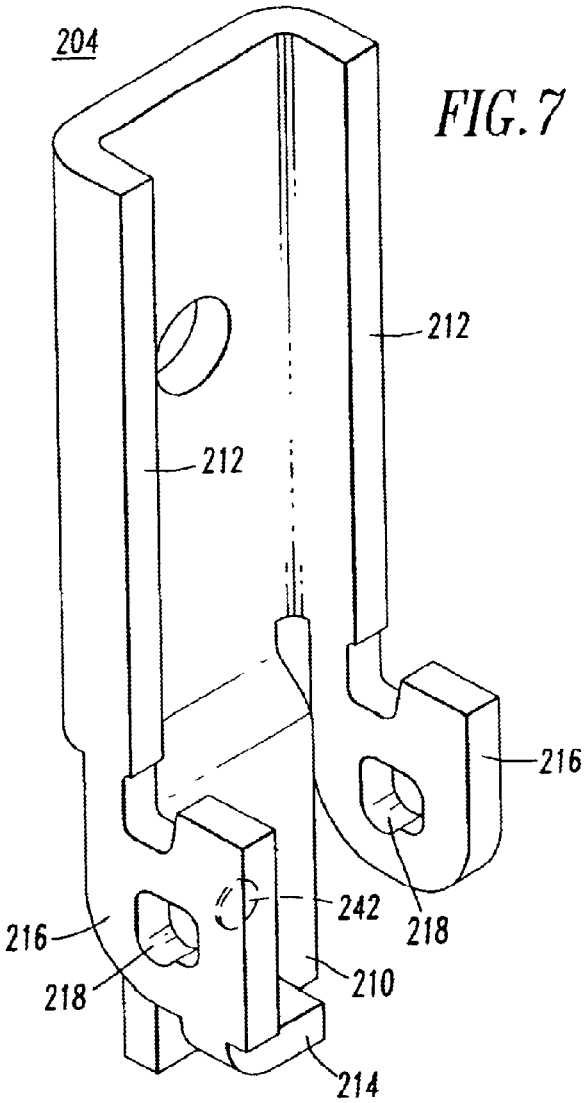
FIG. 7 is an isometric view of the magnetic bracket of FIG. 5.

Also referring to FIG. 7, the magnetic member 204 includes a leg 210, which is suitably coupled (e.g., attached; welded) to the bimetal member 100. The magnetic member 204 is a generally U-shaped magnetic yoke including a pair of legs 212 facing the armature 206 of FIGS. 5 and 6. The magnetic member 204 also includes an arm 214 and a pair of ears 216 having a pair of openings 218 (FIG. 5). Each of the ears 216 is attached to a corresponding one of the legs 212. As shown in FIG. 5, the ears 216 of the magnetic member 204 are folded over, in order to capture the armature 206.

Figure 8:
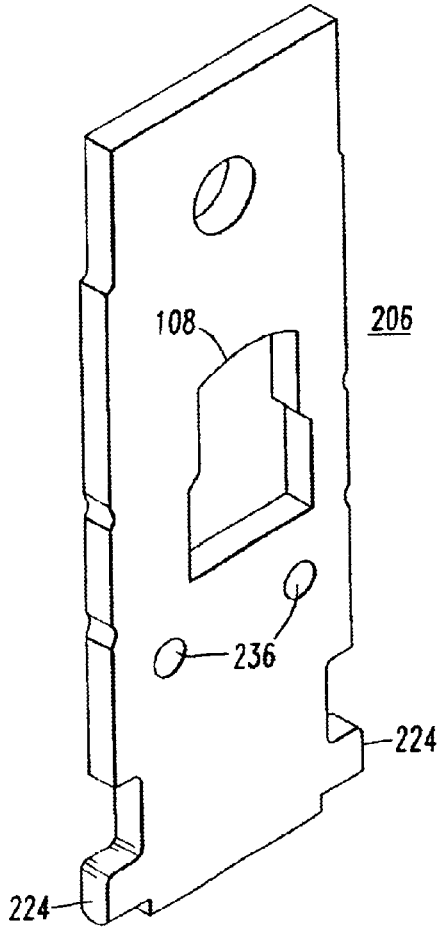
FIG. 8 is an isometric view of the armature of FIG. 5.

FIG. 8 shows the armature 206, which includes the opening 108. The generally planar member 88 of the operating mechanism cradle 82 has the latch ledge 94 (FIG. 3), which forms a latch surface 222. The latch surface 222 is latched by the armature 206 at about the opening 108 thereof. The armature 206 pivots toward the magnetic member 204 responsive to the predetermined condition of current (instantaneous) flowing in the bimetal member 100. In turn, the armature 206 responsively unlatches the latch surface 222 of the cradle 82. The armature 206 includes a pair of legs 224, which pivotally engage the magnetic member 204 at the openings 218 of the ears 216 as shown in FIG. 5.

Figure 9:
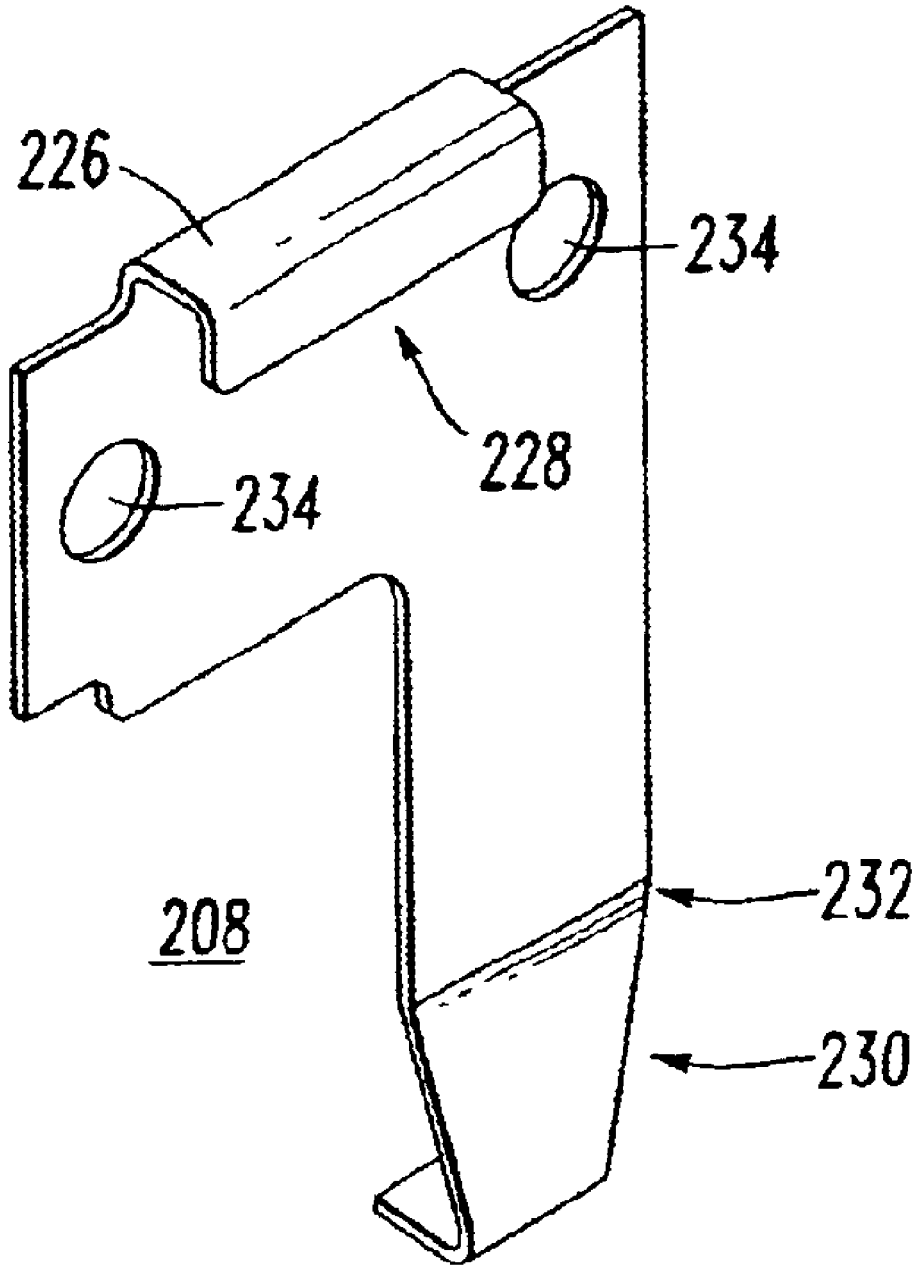
FIG. 9 is an isometric view of the armature spring of FIG. 5.

FIG. 9 shows the armature spring 208, which includes a latch skin 226. The latch skin 226 engages the armature 206 at the opening 108 thereof as shown in FIG. 5. The latch surface 222 of the cradle 82 is latched by the armature 206 at the latch skin 226 of the spring 208. The spring 208 includes a first portion 228, which engages the armature 206 at the opening 108 thereof, a second portion 230 and a bend portion 232 between the first and second portions 228,230. The second portion 230 of the spring 208 flexes and engages the arm 214 of the magnetic member 204 of FIG. 5, thereby biasing the armature 206 away from the magnetic member 204.

The spring 208 includes one or more openings, such as 234, and the armature 206 of FIG. 8 includes one or more corresponding openings, such as 236. The spring 208 is coupled to the armature 206 at the opening 234 of the spring 208 and the openings 236 of the armature 206 by one or more rivets, such as 238, as shown in FIG. 5.

The magnetic member 204, the armature 206 and the spring 208 form a single assembly 240 as shown in FIG. 5, which is attached to a portion 241 of the bimetal member 100 at a bight portion 242 of the leg 210 of the magnetic member 204 of FIG. 7.

When the circuit breaker 10 is in the first, closed position shown in FIG. 1, a persistent overload current of a predetermined value causes the bimetal member 100 to become heated and deflect to the right, as viewed in the figures, to effect a time delayed thermal tripping operation. The armature 206, which is pivotally supported by the magnetic member 204, is carried to the right with the bimetal member 100 to release the cradle 82. When the cradle 82 is released, the trip spring 86 rotates the cradle clockwise about the second pivot point 66. During this movement, the line of action of the trip spring 86 moves to the right of the point at which the operating arm 50 is pivoted about the operating arm notch 55 to rotate the operating arm 50 counterclockwise to snap the fixed and movable contacts 28,53 open. In addition, the handle member 42 is rotated clockwise to position the handle member radial extension 47, which is visible outside of the circuit breaker housing 12, to the intermediate position between the first, closed and second, open positions thereby providing a visual indication that the circuit breaker 10 has tripped open.

Before the contacts 28,53 can be closed following an automatic tripping operation, it is necessary to reset and relatch the operating mechanism assembly 40. This is accomplished by moving the handle member 42 clockwise from the intermediate position to the third, reset position which is slightly beyond the second, open position to relatch the cradle 82. During this movement, due to the engagement of the cradle 82 by the handle member 42 at the handle contact point 92, the cradle 82 is moved counterclockwise about the second pivot point 66 until the latch ledge 94 of the cradle 82 is again latched in the opening 108 of the armature 206. The handle member 42 may then be moved in a counterclockwise direction to the first, closed position shown in FIG. 1. This action moves the upper end of the operating arm 50 to the right of the line of action of the trip spring 86 to close the contacts 28,53.

The circuit breaker 10 is magnetically tripped automatically, and instantaneously, in response to overload currents above a second predetermined value, which is higher than the first predetermined value for the thermal trip. Flow of overload current above this higher predetermined value through the bimetal member 100 induces magnetic flux around the bimetal member 100. This flux is concentrated by the magnetic member 204 toward the armature 206. An overload current above the second predetermined value generates a magnetic force of such a strength that the armature 206 is attracted toward the magnetic member 204 resulting in the flexing of the spring 208 permitting the armature 206 to move to the right to release the cradle 82 and trip the circuit breaker 10 open in the same manner as described with regard to thermal tripping operation. Following a magnetic trip operation, the circuit breaker 10 is reset and relatched in the same manner as described above.

The handle member 42 may be used to manually open and close the contacts 28,53. More specifically, when going from the first, closed position to the second, open position, the handle member 42 is moved in a clockwise direction from the handle position as shown in FIG. 1. Due to the tension which exists in trip spring 86 to maintain the contacts 28,53 in the closed position, a sufficient amount of force must be applied to the handle member 42 so as to overcome the tension in the trip spring 86 and allow the handle member 42 to move in a clockwise direction. As the force is applied and handle member 42 begins to move in the clockwise direction, the upper end of operating arm 50 also begins to move in a counterclockwise direction as a result of the driving connection provided between the handle member 42 and the operating arm notch 55. This cooperation defines the operating arm pivot point 120 about which the operating arm 50 is pivoted on the handle member 42 to rotate the operating arm 50. During the described counterclockwise movement of the upper end of operating arm 50, the lower end of operating arm 50 begins to move in a counterclockwise direction as well (i.e., the movable contact 53, which is mounted on the operating arm 50, begins to move in a counterclockwise direction away from fixed contact 28). The lower end of trip spring 86 is also carried in a counterclockwise direction along with the lower end of operating arm 50 due to the spring 86 being connected to spring tab 56 which is located at the lower end of the operating arm 50.

The sequence of events described thus far results from a sufficient amount of force being applied to handle member 42 in order to overcome the tension in the trip spring 86. Then, once a sufficient amount of force has been applied to move the line of action of trip spring 86 to the right of the operating arm pivot point 120 (i.e., over center) about which operating arm 50 is pivoted, the amount of tension in the spring begins to decrease, thus carrying the line of action of the trip spring 86 even further to the right in a counterclockwise direction until finally coming to rest along a second line of action. Of course, the lower end of operating arm 50 also continues to move in a counterclockwise direction as a result of operating arm spring tab 56 being connected to the trip spring 86. Once the trip spring 86 reaches the second line of action and comes to rest, the operating arm 50 also comes to rest. More specifically, once the operating arm 50 comes to rest, the contacts 28,53 are in the second, open position and the handle member 42 is in the second, open position as well.

Once the trip spring 86 moves to the right of the operating arm pivot point 120 (i.e., over center), then no additional force needs to be manually applied to handle member 42 in order for the handle member 42 to continue to move from the first, closed position to the second, open position. The trip spring 86 becomes the driving force for moving the handle member 42 to the second, open position as a result of the spring moving to the right of the pivot point and continuing to the right as the tension decreases in the trip spring 86. This, in turn, results in continued movement of the lower end of operating arm 50 in the counterclockwise direction which results in the upper end of the operating arm 50 also moving in a counterclockwise direction and driving the radial extension 47 of handle member 42 in a clockwise direction until the radial extension 47 reaches the second, open position. The driving force for moving handle member 42 is thus provided by the operating arm notch 55 pushing against operating arm tab 48. This pushing action between the operating arm notch 55 and operating arm tab 48 is caused by the trip spring 86 moving to the right causing the lower end of the operating arm 50 to move in a counterclockwise direction and forcing the upper end of the operating arm in a counterclockwise direction so on, as previously described.

The structures at the first and second pivot points 64, 66 may be constructed of metal. For example, as shown in FIG. 4, there may be a metal pivot structure 150 at the first and second pivot points 64,66. The metal pivot structure 150 may be a simple member 65,67 as discussed above, however, the metal pivot structure 150 at the second pivot point 66 may be a shoulder 152 extending from the frame assembly 60. The cradle planar member 88 includes a pivot opening 90 that is structured to engage the shoulder 152. Thus, the cradle planar member 88 is pivotally coupled to the frame assembly 60. The frame assembly 60 may further include a cradle pivot tab 156 upon which the shoulder 152 is disposed. The shoulder 152 may be an extruded disk 158, which is integral to the frame assembly 60.

Because the cradle planar member 88, which is typically made from metal, is coupled to the metal pivot structure 150 on the frame assembly 60, and because the trip spring 86 extending between the operating arm 50 and the cradle planar member 88 is typically metal, there exists a second electrical circuit through the operating mechanism assembly 40. That is, when the operating arm 50 is in the first, closed position, this second electrical circuit extends through the circuit breaker 10 from the first terminal conductor 14, through the fixed contact 28, the movable contact 53, the operating arm 50, the trip spring 86, the cradle planar member 88, the frame-assembly 60, the first flexible conductor 110, the contact pad 30, and the second terminal conductor 16. Because the second conductor 112 is typically copper, electricity is more likely to flow through the first electrical circuit described above. A small amount of electricity, however, may leak through the second electrical circuit and bypass the trip assembly 84.

Alternatively, the operating mechanism assembly 40 may also include a non-conductive barrier (not shown) coupled to one, or both, ends of the trip spring 86. This non-conductive barrier may be a bushing (not shown) made of a suitable non-conductive material, such as a thermo-set material (e.g., phenolic), disposed on the cradle trip spring projection 96. Alternatively, the non-conductive barrier may be a non-conductive bushing (not shown) disposed on the operating arm spring tab 56. Alternatively, the non-conductive barrier (not shown) may be incorporated into the trip spring 86. That is, the trip spring 86 may be made from a suitable non-conductive material. In this manner, as long as electricity cannot flow through the trip spring 86, the second circuit will not exist.

The exemplary magnetic bracket/armature assembly 200 provides robust performance while improving handling capabilities during assembly. The exemplary formed steel magnetic bracket 204 functions as a magnet, while providing a mechanism for pivotally retaining the armature 206.

Although the invention has been disclosed in connection with the circuit breaker 10 including the exemplary unitary operating mechanism assembly 40 and the trip assembly 84, the invention is application to a wide range of circuit breakers employing a wide range of operating mechanisms (e.g., non-unitary) and trip mechanisms, with or without bimetal conductors, such as 100.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any all equivalents thereof.

What is claimed is:

1. A circuit breaker comprising:

separable contacts;

an operating mechanism for opening and closing said separable contacts;

a conductor electrically connected in series with said separable contacts;

a trip mechanism cooperative with said operating mechanism to trip open said separable contacts, said trip mechanism responsive to a predetermined condition of current flowing in said conductor, said trip mechanism comprising:

a magnetic member coupled to said conductor, an armature pivotally mounted to said magnetic member, and a spring set apart from said conductor and biasing said armature away from said magnetic member.

2. The circuit breaker of claim 1 wherein said armature includes an opening; and wherein said operating mechanism includes a cradle having a latch surface, which is latched by said armature at about the opening thereof.

3. The circuit breaker of claim 2 wherein said spring includes a latch skin, which engages said armature at the opening thereof; and wherein the latch surface of said cradle is latched by said armature at the latch skin of said spring.

4. The circuit breaker of claim 2 wherein said armature pivots toward said magnetic member responsive to said predetermined condition of current flowing in said conductor; and wherein said armature responsively unlatches the latch surface of said cradle.

5. The circuit breaker of claim 1 wherein said magnetic member includes a leg coupled to said conductor.

6. The circuit breaker of claim 5 wherein said conductor is a bimetal, which is welded to the leg of said magnetic member.

7. The circuit breaker of claim 1 wherein said magnetic member includes a generally U-shaped magnetic yoke.

8. The circuit breaker of claim 7 wherein said generally U-shaped magnetic yoke includes a pair of legs facing said armature.

9. The circuit breaker of claim 8 wherein said pair of legs is a pair of first legs; and wherein said magnetic member includes a second leg coupled to said conductor.

10. The circuit breaker of claim 1 wherein said armature includes an opening; wherein said magnetic member includes an arm; and wherein said spring includes a first portion, which engages said armature at the opening thereof, a second portion and a bend portion between the first and second portions, the second portion of said spring flexing and engaging the arm of said magnetic member, thereby biasing said armature away from said magnetic member.

11. The circuit breaker of claim 10 wherein the opening of said armature is a first opening; wherein said spring includes at least one second opening; wherein said armature includes at least one third opening; and wherein said spring is coupled to said armature at said at least one second opening of said spring and said at least one third opening of said armature.

12. The circuit breaker of claim 11 wherein at least one rivet couples said spring to said armature at said at least one second opening of said spring and said at least one third opening of said armature.

13. The circuit breaker of claim 1 wherein said magnetic member includes a pair of ears having a pair of openings, and wherein said armature includes a pair of legs which pivotally engage said magnetic member at the openings of said ears.

14. The circuit breaker of claim 13 wherein the ears of said magnetic member are folded over, in order to capture said armature.

15. The circuit breaker of claim 14 wherein said magnetic member includes a generally U-shaped magnetic yoke having a pair of legs facing said armature; and wherein each of said ears is attached to a corresponding one of said legs.

16. A circuit breaker comprising:

separable contacts;

an operating mechanism for opening and closing said separable contacts;

a conductor electrically connected in series with said separable contacts;

a trip mechanism cooperative with said operating mechanism to trip open said separable contacts, said trip mechanism responsive to a predetermined condition of current flowing in said conductor, said trip mechanism comprising:

a magnetic member coupled to said conductor, an armature pivotally mounted to said magnetic member, and a spring set apart from said conductor and biasing said armature away from said magnetic member, said spring coupled to said armature and engaging said magnetic member.

17. The circuit breaker of claim 16 wherein said armature includes an opening; wherein said magnetic member includes an arm; and wherein said spring includes a first portion, which engages said armature at the opening thereof, a second portion and a bend portion between the first and second portions, the second portion of said spring flexing and engaging the arm of said magnetic member, thereby biasing said armature away from said magnetic member.

18. The circuit breaker of claim 17 wherein the opening of said armature is a first opening; wherein said spring includes at least one second opening; wherein said armature includes at least one third opening; and wherein said spring is coupled to said armature at said at least one second opening of said spring and said at least one third opening of said armature.

19. A circuit breaker comprising:

separable contacts;

an operating mechanism for opening and closing said separable contacts, said operating mechanism comprising a cradle; and a trip mechanism cooperative with the cradle of said operating mechanism to trip open said separable contacts, said trip mechanism comprising:

a bimetal conductor electrically connected in series with said separable contacts, said trip mechanism responsive to a first predetermined condition of current flowing in said bimetal conductor, a magnetic member coupled to said bimetal conductor, an armature pivotally mounted to said magnetic member, the cradle of said operating mechanism latched on and tripped by said armature, said armature and said magnetic member responsive to a second predetermined condition of current flowing in said bimetal conductor, and a spring biasing said armature away from said magnetic member, said spring set apart from said bimetal conductor, coupled to said armature and engaging said magnetic member.

20. The circuit breaker of claim 19 wherein said armature includes an opening; wherein the cradle of said operating mechanism has a latch surface, which is latched by said armature at about the opening thereof; wherein said armature pivots toward said magnetic member responsive to said second predetermined condition of current flowing in said bimetal conductor; and wherein said armature responsively unlatches the latch surface of said cradle.

21. The circuit breaker of claim 20 wherein said spring includes a latch skin, which engages said armature at the opening thereof; and wherein the latch surface of said cradle is latched by said armature at the latch skin of said spring.

22. The circuit breaker of claim 19 wherein said magnetic member is attached to said bimetal conductor.

23. The circuit breaker of claim 19 wherein said magnetic member, said armature and said spring form a single assembly, which is attached to said bimetal conductor at said magnetic member.

* * * * *